US009898938B1

(12) United States Patent
Perrin

(10) Patent No.: US 9,898,938 B1
(45) Date of Patent: Feb. 20, 2018

(54) TRIFOLD LETTER CARD DISPLAY

(71) Applicant: Candas Perrin, Atlanta, GA (US)

(72) Inventor: Candas Perrin, Atlanta, GA (US)

( * ) Notice: Subject to any disclaimer, the term of this patent is extended or adjusted under 35 U.S.C. 154(b) by 0 days.

(21) Appl. No.: 15/281,352

(22) Filed: Sep. 30, 2016

(51) Int. Cl.
*G09F 1/00* (2006.01)
*G09F 1/06* (2006.01)

(52) U.S. Cl.
CPC ..... *G09F 1/06* (2013.01)

(58) Field of Classification Search
CPC ..... G09F 1/04; G09F 1/06; G09F 1/00; B42D 15/042
USPC ..... 40/124.09–124.15
See application file for complete search history.

(56) References Cited

U.S. PATENT DOCUMENTS 1,411,022 A * 3/1922 Heidenreich ..... G09F 1/04 248/459
1,705,116 A * 3/1929 Howland ..... G09D 3/02 40/120
2,881,662 A * 4/1959 Harris ..... B60Q 7/005 116/63 P
3,174,244 A * 3/1965 Walton ..... B42D 15/042 229/82
3,427,642 A * 2/1969 Mohr ..... B42D 15/042 40/124.08
4,182,063 A * 1/1980 Klosel ..... B60Q 7/005 116/63 P
4,251,935 A * 2/1981 Wright ..... G09D 3/04 283/2
4,541,190 A * 9/1985 Weiner ..... B60Q 7/005 40/124.15
4,813,902 A * 3/1989 Messer ..... G09F 1/06 40/124.15
5,010,669 A * 4/1991 Moran ..... G09F 1/08 229/92.8
6,050,604 A * 4/2000 Ossiatzky ..... A63H 33/38 283/117
6,306,485 B1 * 10/2001 Keller ..... B44C 1/105 40/124.08
6,438,877 B1 * 8/2002 Ruiz ..... G09F 1/06 40/124.04
7,316,085 B1 * 1/2008 Freeman ..... G09F 1/06 281/38
D665,446 S 8/2012 Mayer et al.
D746,371 S 12/2015 Stevens
2003/0136036 A1 * 7/2003 Zubli ..... G09F 1/04 40/124.15
2008/0127536 A1 * 6/2008 Carter ..... G09F 1/06 40/124.08
2009/0064547 A1 * 3/2009 Condor ..... G09F 1/06 40/124.14

FOREIGN PATENT DOCUMENTS

GB 2295121 A 5/1996

* cited by examiner

*Primary Examiner* — Shin Kim
(74) *Attorney, Agent, or Firm* — Alston & Bird LLP

(57) ABSTRACT

Various embodiments provide a trifold letter card comprising a first riser portion, a second riser portion, a base portion, and an engaging portion. The engaging portion comprises at least three segments and at least two slits. Such structures allow the first riser portion to be inserted through the at least two slits and secured relative to the engaging portion.

20 Claims, 9 Drawing Sheets

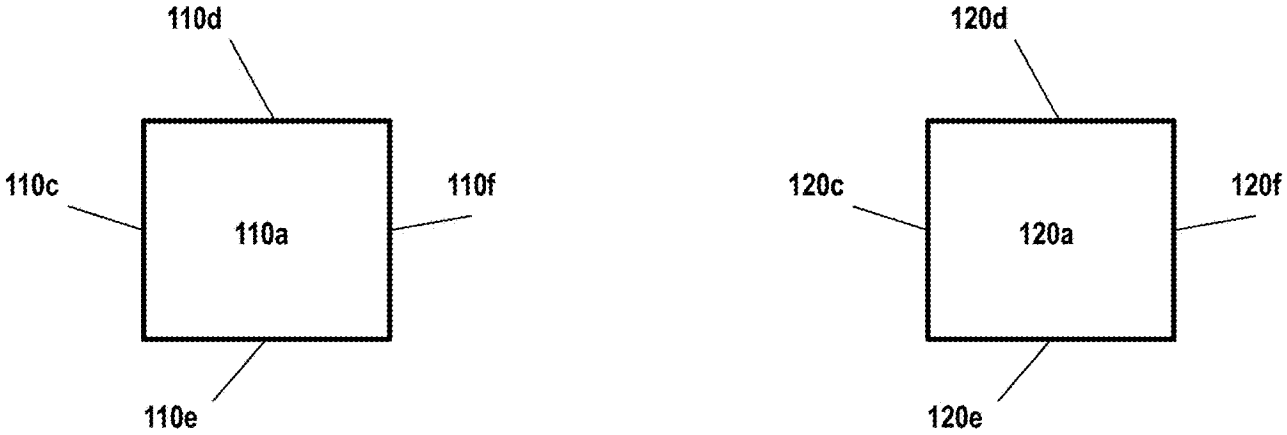
Fig. 4A
Fig. 4B
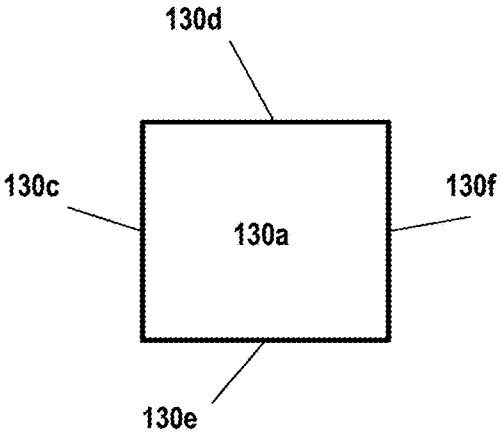
Fig. 4C

TRIFOLD LETTER CARD DISPLAY

BACKGROUND

There are many instances in which individuals wish to display letter cards on a flat surface. However, conventional letter cards are of a single card construction having a front side and a rear side. It is difficult for the cards to be conveniently sat on a flat surface. Therefore, a need exists in the art for a letter card that can be easily set up for display on a flat surface, while at the same time being portable like conventional cards if needed.

BRIEF SUMMARY

Various embodiments provide a trifold letter card comprising (A) a base portion; (B) a first riser portion; (C) a second riser portion; (D) an engaging portion; and (E) an enclosure portion. According to various embodiments: (1) the base portion comprises a first side edge, a second side edge, a third side edge, a fourth side edge, a first surface, and a second surface, wherein the first side edge and the third side edge of the base portion are opposite side edges of the base portion and are substantially parallel to one another, and the second side edge and the fourth side edge of the base portion are opposite side edges of the base portion; (2) the first riser portion comprises a first side edge, a second side edge, a third side edge, a fourth side edge, a first surface, and a second surface, wherein the first side edge and the third side edge of the first riser portion are opposite side edges of the first riser portion and are substantially parallel to one another, and the second side edge and the fourth side edge of the first riser portion are opposite side edges of the first riser portion; (3) the second riser portion comprises a first side edge, a second side edge, a third side edge, a fourth side edge, a first surface, and a second surface, wherein: (a) the first side edge and the third side edge of the second riser portion are opposite side edges of the second riser portion and are substantially parallel to one another, the second side edge and the fourth side edge of the second riser portion are opposite side edges of the second riser portion; (b) the third side edge of the first riser portion and the first side edge of the second riser portion collectively define a first crease line; and (c) the third side edge of the second riser portion and the first side edge of the base portion collectively define a second crease line; (4) the engaging portion comprises a first side edge, a second side edge, a third side edge, a fourth side edge, a first surface, a second surface, at least three segments, and at least two slits, wherein: (a) the first side edge and the third side edge of the engaging portion are opposite side edges of the engaging portion, and the second side edge and the fourth side edge of the engaging portion are opposite side edges of the engaging portion; (b) the third side edge of the base portion and the first side edge of the engaging portion collectively define a third crease line; (c) each of the at least three segments comprising a first side edge, a second side edge, a third side edge, a fourth side edge, a first surface, a second surface, wherein the first side edge and the third side edge of each of the at least three segments are opposite side edges of the corresponding segment, and the second side edge and the fourth side edge of each of the at least three segments are opposite side edges of the corresponding segment; (d) the first side edge of a first segment of the at least three segments defines the fourth side edge of the engaging portion, the fourth side edge of a third segment of the at least three segments defines the second side edge of the engaging portion, the fourth side edges of the at least three segments in the engaging portion collectively define the first side edge of the engaging portion, the second side edges of the at least three segments in the engaging portion collectively define the fourth side edge of the engaging portion, the first surfaces of the at least three segments collectively define the first surface of the engaging portion, and the second surfaces of the at least three segments collectively define the second surface of the engaging portion; (e) the third side edge of a first segment of the at least three segments and the first side edge of a second segment of the at least three segments collectively define a first slit of the engaging portion, wherein the first segment is adjacent to the second segment, and the first slit starts from a point on the third side edge of the engaging portion and ends before reaching the first side edge of the engaging portion; (f) the third side edge of the second segment of the at least three segments and the first side edge of a third segment of the at least three segments collectively define a second slit of the engaging portion, wherein the second segment is adjacent to the third segment, and the second slit starts from another point on the third side edge of the engaging portion and ends before reaching the first side edge of the engaging portion; and (g) the at least two slits of the engaging portion receive and engage the first riser portion from an end at the first side edge of the first riser portion, and secure the first riser portion to the engaging portion. Still further, the enclosure portion comprises three side walls and two opposing ends, wherein: (a) a first side wall is the base portion, a second side wall is the second riser portion, and a third side wall is formed by the first riser portion engaged with the engaging portion; and (b) the two opposing ends are open, wherein a first end of the two opposing ends is formed by the fourth side edges of the base portion, the second riser portion, the first riser portion and the engaging portion, wherein the first riser portion is secured to the engaging portion, a second end of the two opposing ends is formed by the second side edges of the base portion, the second riser portion, the first riser portion and the engaging portion, wherein the first riser portion is secured to the engaging portion.

Various embodiments further provide a method for making a trifold letter card, wherein the trifold letter card comprises: a first riser portion with a first side edge and a third side edge in parallel, a second riser portion with a first side edge and a third side edge in parallel, a base portion with a first side edge and a third side edge in parallel, and an engaging portion with a first side edge and a third side edge opposing to the first side edge, wherein the third side edge of the first riser portion and the first side edge of the second riser portion collectively define a first crease line, the first side edge of the base portion and the third side edge of the second riser portion collectively define a second crease line, the first side edge of the engaging portion and the third side edge of the base portion collectively define a third crease line, the engaging portion has at least two slits and at least three segments, wherein each of the two slits is formed by two side edges of two adjacent segments, and starts from a point along the third side edge of the engaging portion and ends before reaching the first side edge of the engaging portion. In these embodiments, the method comprises the steps of: (1) folding the engaging portion at an acute angle, an approximate right angle, or an obtuse angle relative to the base portion; (2) folding the first riser portion at an acute angle, an approximate right angle, or an obtuse angle relative to the second riser portion; (3) folding the second riser portion at an acute angle relative to the base portion; (4) adjusting the angles formed by the second riser portion and the base portion, by the engaging portion and the base portion, and by the first riser portion and the second riser portion so that the first side edge of the first riser portion is substantially aligned with the fourth side edge of the engaging portion; and (5) inserting the first riser portion into the at least two slits of the engaging portion so as to secure the first riser portion relative to the engaging portion.

Various embodiments likewise provide a blank configured to be used to form a trifold letter card, the blank comprising (A) a base portion; (B) a first riser portion; (C) a second riser portion; and (D) an engaging portion. According to various embodiments: (1) the base portion comprises a first side edge, a second side edge, a third side edge, a fourth side edge, a first surface, and a second surface, wherein the first side edge and the third side edge of the base portion are opposite side edges of the base portion and are substantially parallel to one another, and the second side edge and the fourth side edge of the base portion are opposite side edges of the base portion; (2) the first riser portion comprises a first side edge, a second side edge, a third side edge, a fourth side edge, a first surface, and a second surface, wherein the first side edge and the third side edge of the first riser portion are opposite side edges of the first riser portion and are substantially parallel to one another, and the second side edge and the fourth side edge of the first riser portion are opposite side edges of the first riser portion; (3) the second riser portion comprises a first side edge, a second side edge, a third side edge, a fourth side edge, a first surface, and a second surface, wherein: (a) the first side edge and the third side edge of the second riser portion are opposite side edges of the second riser portion and are substantially parallel to one another, the second side edge and the fourth side edge of the second riser portion are opposite side edges of the second riser portion; (b) the third side edge of the first riser portion and the first side edge of the second riser portion collectively define a first crease line; and (c) the third side edge of the second riser portion and the first side edge of the base portion collectively define a second crease line; (4) the engaging portion comprises a first side edge, a second side edge, a third side edge, a fourth side edge, a first surface, a second surface, at least three segments, and at least two slits, wherein: (a) the first side edge and the third side edge of the engaging portion are opposite side edges of the engaging portion, and the second side edge and the fourth side edge of the engaging portion are opposite side edges of the engaging portion; (b) the third side edge of the base portion and the first side edge of the engaging portion collectively define a third crease line; (c) each of the at least three segments comprising a first side edge, a second side edge, a third side edge, a fourth side edge, a first surface, a second surface, wherein the first side edge and the third side edge of each of the at least three segments are opposite side edges of the corresponding segment, and the second side edge and the fourth side edge of each of the at least three segments are opposite side edges of the corresponding segment; (d) the first side edge of a first segment of the at least three segments defines the fourth side edge of the engaging portion, the fourth side edge of a third segment of the at least three segments defines the second side edge of the engaging portion, the fourth side edges of the at least three segments in the engaging portion collectively define the first side edge of the engaging portion, the second side edges of the at least three segments in the engaging portion collectively define the fourth side edge of the engaging portion, the first surfaces of the at least three segments collectively define the first surface of the engaging portion, and the second surfaces of the at least three segments collectively define the second surface of the engaging portion; (e) the third side edge of a first segment of the at least three segments and the first side edge of a second segment of the at least three segments collectively define a first slit of the engaging portion, wherein the first segment is adjacent to the second segment, and the first slit starts from a point on the third side edge of the engaging portion and ends before reaching the first side edge of the engaging portion; and (f) the third side edge of the second segment of the at least three segments and the first side edge of a third segment of the at least three segments collectively define a second slit of the engaging portion, wherein the second segment is adjacent to the third segment, and the second slit starts from another point on the third side edge of the engaging portion and ends before reaching the first side edge of the engaging portion.

BRIEF DESCRIPTION OF THE SEVERAL VIEWS OF THE DRAWING(S)

Having thus described the invention in general terms, reference will now be made to the accompanying drawings, which are not necessarily drawn to scale.

Figure 3A:
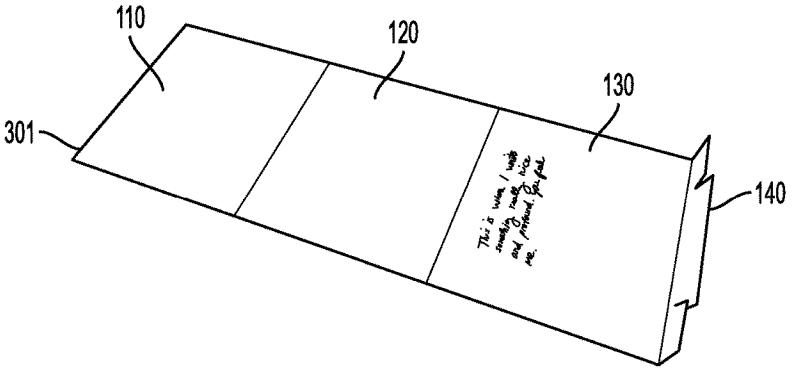
FIG. 3A is a top view of an embodiment of the blank 101 in a second configuration with an engaging portion 140 folded according to the present invention.
Figure 3C:
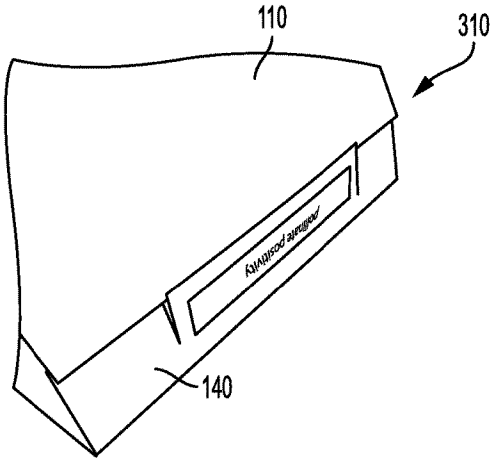
FIG. 3B is a partial view of FIG. 3A, focusing on the structure of an engaging portion 140.
Figure 5A:
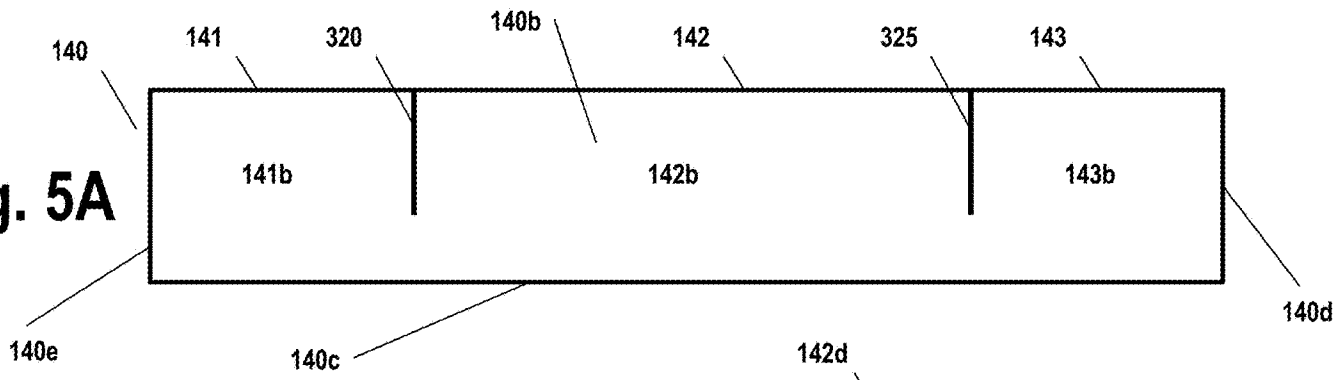
Figure 5B:
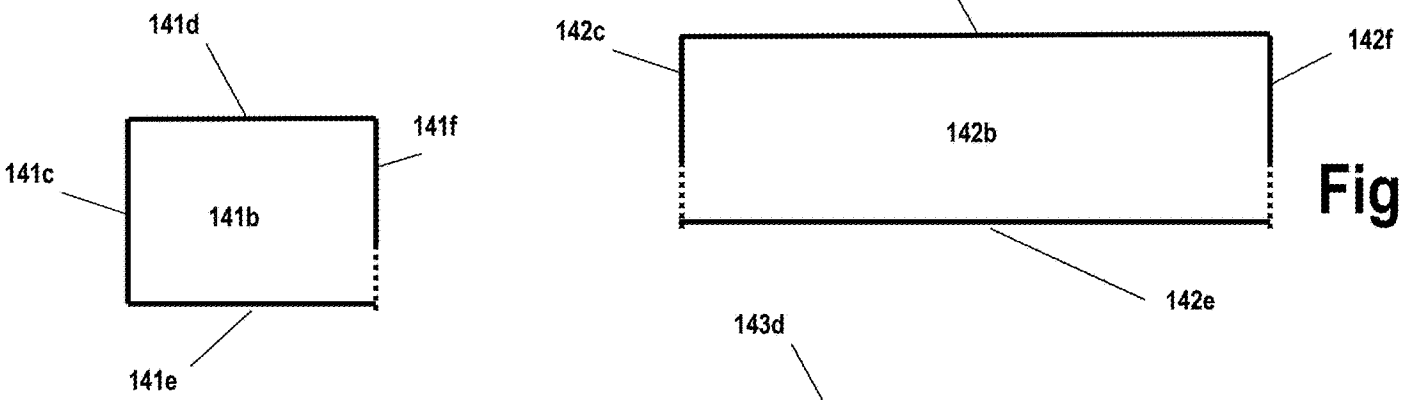
Figure 5C:
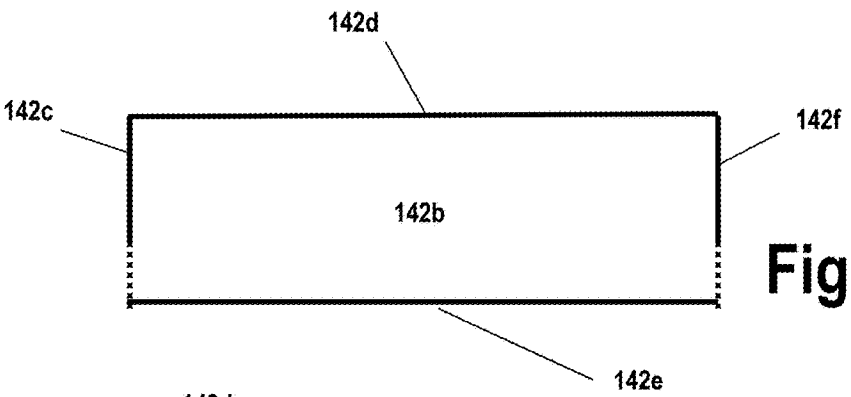
Figure 5D:
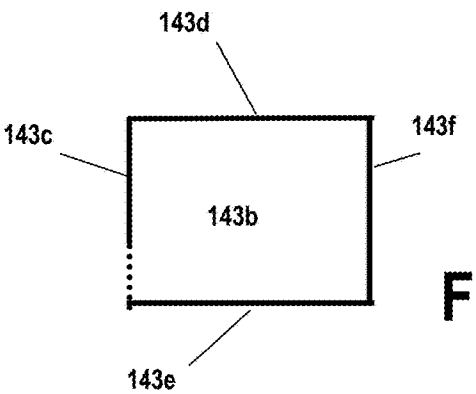
Figure 6:
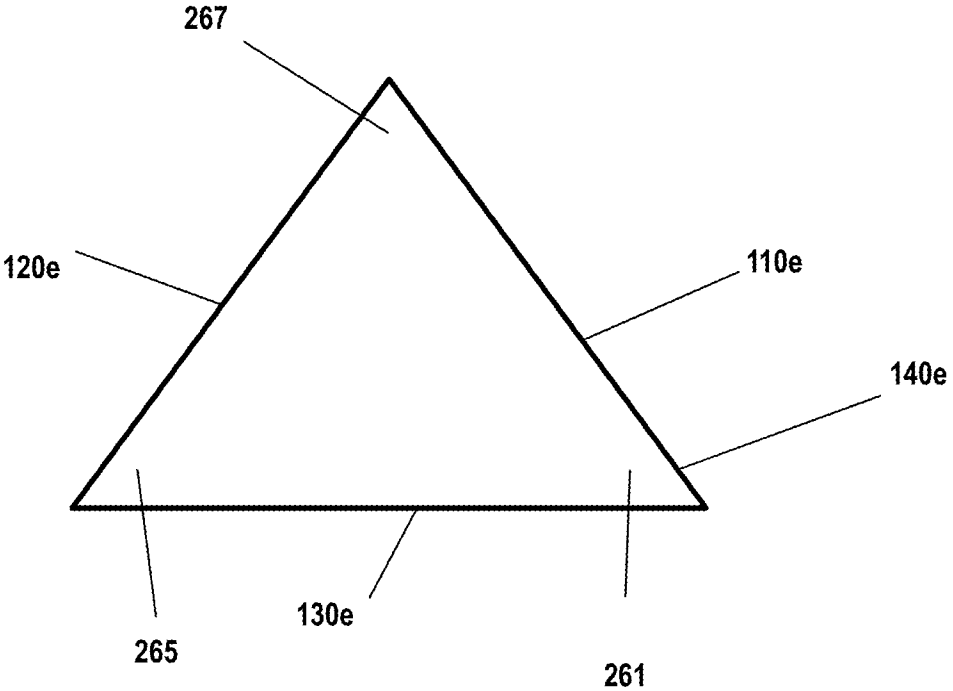
Figure 7B:
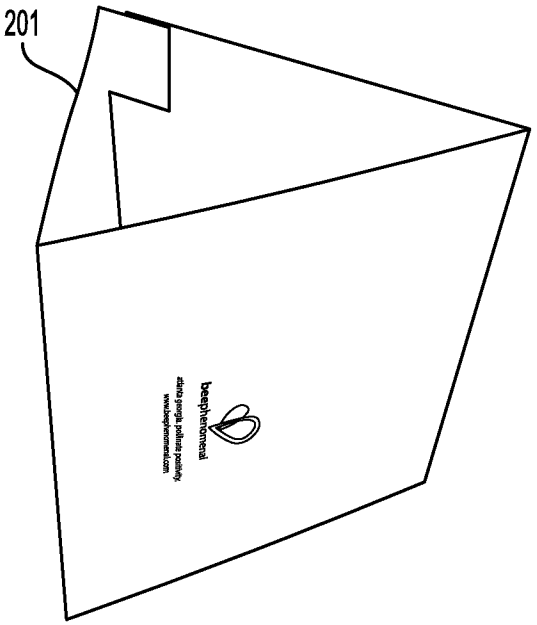
Figure 7A:
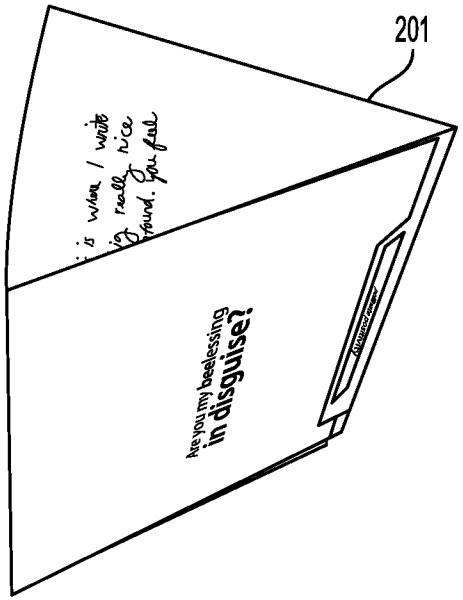
Figure 8B:
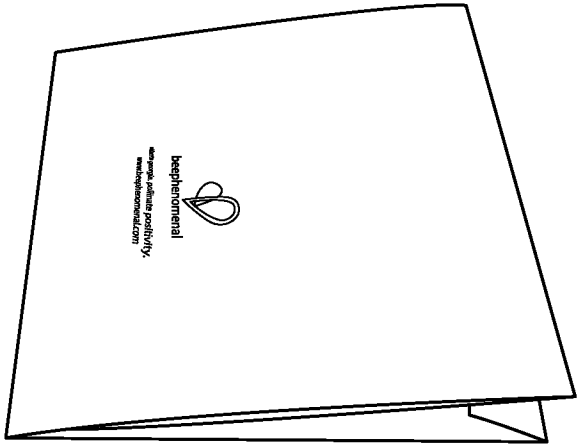
Figure 8A:
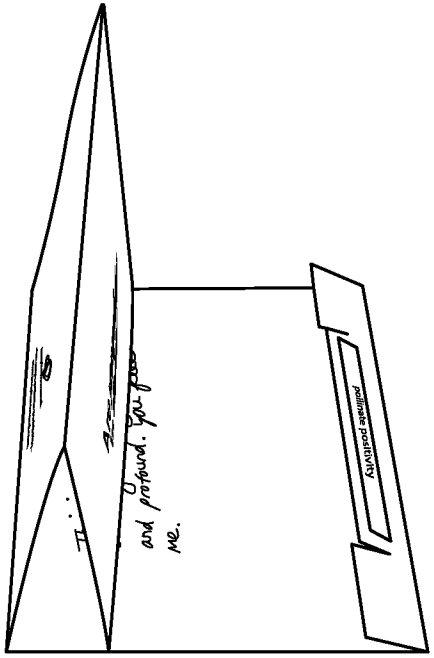

FIG. 3C is a partial pictorial view of an embodiment of the blank 101 partially assembled into the trifold letter card, focusing on the engagement of a riser portion 110 and the engaging portion 140, according to the present invention;

FIGS. 4A-4C show a top view of a first portion 110, a second portion 120, and a third portion 130 of an embodiment of the blank 101, respectively, with a first surface facing up, according to the present invention;

FIG. 5A shows a top view of a fourth portion 140 of an embodiment of the blank 101, with a second surface facing up, according to the present invention;

FIGS. 5B-5D show a top view of two short segments 141 and 142 and a long segment 142 of the portion 140 in FIG. 5A, respectively;

FIG. 6 shows a side view of an embodiment of the trifold letter card 201, focusing on three angular portions of the trifold letter card 201, according to the present invention;

FIG. 7A is a pictorial view of an embodiment of the trifold letter card 201 in a second upright configuration atop a supporting surface according to the present invention;

FIG. 7B is another pictorial view of an embodiment of the trifold letter card 201 in the second upright configuration according to the present invention, viewed from another perspective;

FIG. 8A shows a pictorial view of the blank 101 in a first to-be-closed configuration according to the present invention;

FIG. 8B shows a pictorial view of the blank 101 in a first closed configuration according to the present invention.

FIGS. 9A-D show four pictorial views of an embodiment of the blank 101 in a process of being assembled into the trifold letter card according to the present invention;

DETAILED DESCRIPTION OF VARIOUS EMBODIMENTS

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Unless otherwise defined, all technical and scientific terms used herein have the same meaning as commonly understood by one of ordinary skill in the art to which this invention belongs. The terminology used in the description is for describing particular embodiments only and is not intended to be limiting to embodiments of the present invention. As used in the description, the singular forms "a," "an," and "the" are intended to include the plural forms as well, unless the context clearly indicates otherwise. The term "or" is used herein in both the alternative and conjunctive sense, unless otherwise indicated. The terms "illustrative" and "exemplary" are used to be examples with no indication of quality level.

Unless otherwise indicated, all numbers expressing quantities of dimensions such as length, width, height, and so forth as used in the description are to be understood as being modified in all instances by the term "about." Accordingly, unless otherwise indicated, the numerical properties set forth in the description are approximations that may vary depending on the desired properties sought to be obtained in embodiments of the present invention. Notwithstanding that the approximate numerical ranges and parameters setting forth the broad scope of embodiments of the present invention, the numerical values set forth in the specific examples are reported as precisely as possible. Any numerical values, however, inherently contain certain errors necessarily resulting from error found in their respective measurements.

Still further, while numbers expressing quantities of dimensions such as length, width, height, and sort forth are incorporated throughout the description, such as to be understood as exemplary in nature, versus limiting. In other words, certain embodiments may have dimensions substantially greater than the exemplary numbers expressed herein, while other embodiments may have dimensions substantially less than the same, as may be desirable for particular applications. It should be understood that such variations in dimensions are contemplated and considered within the scope of various embodiments, provided the dimensional aspects of the blank 101 used to make the trifold letter card as a whole provide the previously described benefits of being easily set up for display on a flat surface, while at the same time being portable like conventional cards if needed. Accordingly, for purposes of brevity of disclosure, such variations may be assumed with regard to any remaining described dimensions herein, even where not explicitly described with regard to particular segments or elements.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

I. Structure of Exemplary Trifold Letter Card Blank

Figure 1A:
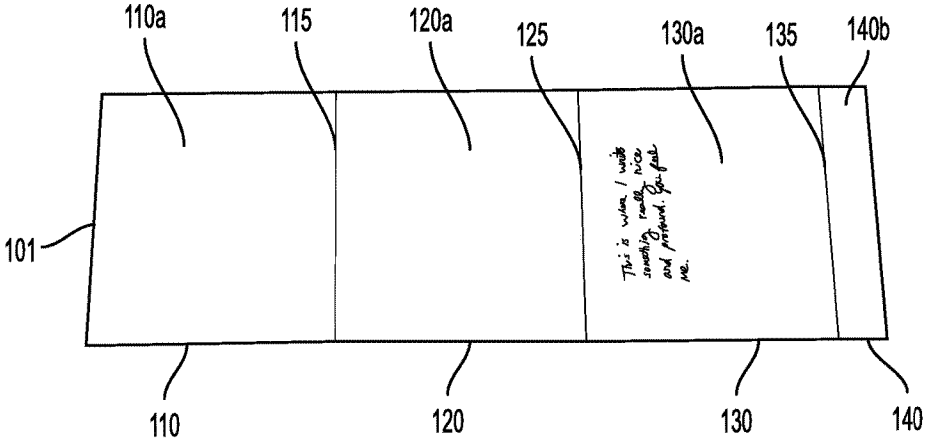
FIG. 1A is a top view of an embodiment of a blank 101 used to make a trifold letter card in a first configuration atop a supporting surface 150, with a first surface facing up, according to the present invention.

FIG. 1 provides an illustration of a trifold letter card blank 101 that may be used to make a trifold letter card 201 displayed atop a flat supporting surface 250 (see also FIGS. 2, 7 and 8) according to various embodiments. In certain embodiments, the trifold letter card 201 is formed by carrying out a sequence of folding steps upon the blank 101. In particular embodiments, the blank 101 is folded along appropriate crease lines 115, 125 and 135 and respective portions are thereby brought by the folding operation into proximity or juxtaposition to other portions, or made to abut or to interlock with other portions of the blank 101, as described in further detail below.

In various embodiments, the crease lines are configured to encourage bending at the crease lines. For instance, in various embodiments, the crease lines may be formed by folding adjacent portions in the blank 101 and pressing folded adjacent portions against each other, by placing indentations in the blank 101, by partial cuts through the body of the blank 101, by placing serrated indentations in the body of the blank 100 that include alternating sections of cuts through the body of the blank 101 and sections without cuts, and/or combinations thereof.

For convenience, the blank 101 is shown in FIG. 1 as a single flat item that may be manufactured as a single piece. However, it should be apparent to one of ordinary skill in the art in light of this disclosure that the blank 101 may be manufactured in multiple pieces that may be adhered to one another through such mechanisms as tape, glue, staples, etc., and/or a combination thereof. In addition, according to various embodiments, the blank 101 may be constructed of any suitable material such as the non-limiting examples of card stocks, waxed paper, thermoplastic polymers, polystyrene, or polyvinyl chloride. In certain embodiments, the suitable material may be formed at least partially or even wholly from recyclable, reground, and/or biodegradable material, as may be desirable in particular applications.

It may be seen from FIG. 1 that various embodiments of the blank 101 include a first riser portion 110, a second riser portion 120, a base portion 130, and an engaging portion 140. Each of the respective portions has a first surface (110*a*, 120*a*, 130*a*, 140*a*), an opposing second surface (110*b*, 120*b*, 130*b*, 140*b*). The color of the first surface and the second surface may be same, or different. Each of the riser portions and base portion has four side edges (110*c-f*, 120*c-f*, 130*c-f*) (see also FIG. 4), and the engaging portion 140 has three side edges (140*c-e*) and a fourth side edge defined collectively by a side edge of each segment of the engaging portion (see also FIG. 5), as will be described in detail below. The side edge 110*f* of the first riser portion 110 and the side edge 120*c* of the second riser portion 120 collectively define a first crease line 115; the side edge 120*f* of the second riser portion 120 and the side edge 130*c* of the base portion 130 collectively define a second crease line 125; and the side edge 130*f* of the base portion 130 and the side edge 140*c* of the engaging portion 140 collectively define a third crease line 135. Each of the respective portions may be substantially rectangular in shape, and dimensions for each may vary among embodiments. For instance, in certain embodiments, the first riser portion 110 may measure approximately 4 11/16 inches (side edges 110*c*, 110*f*) by 4 3/8 inches (side edges 110*d*, 110*e*) (i.e., approximately 119 millimeters by 111 millimeters), the second riser portion 120 may measure approximately 4 11/16 inches (side edges 120*c*, 120*f*) by 4 7/16 inches (side edges 120*d*, 120*e*) (i.e., approximately 119 millimeters by 113 millimeters), the base portion 130 may measure approximately 4 11/16 inches (side edges 130*c*, 130*f*) by 4 3/8 inches (side edges 130*d*, 130*e*) (i.e., approximately 119 millimeters by 111 millimeters), and the engaging portion 140 may measure approximately 4 11/16 inches (side edge 140*c*) by 7/8 inches (side edges 140*d*, 140*e*) (i.e., approximately 119 millimeters by 22 millimeters). As mentioned previously, it should be understood that in other embodiments, these and still other dimensions of the blank 101 may be substantially greater than or substantially less than those recited above, as may be desirable for displaying messages. For purposes of brevity, such variations may be assumed with regarding to any remaining described dimensions. In some embodiments, the dimensions of the first and second riser portions 110 and 120, and the base portion are approximately same. In alternative embodiments, the dimensions of the first and second riser portions 110 and 120 may be approximately same, and the length of the two edge sides 130*d* and 130*e* of the base portion 130 may be smaller or larger than the length of the two edge sides 110*d* and 110*e* of the riser portion 110 while the length of the two edge sides 130*c* and 130*f* may be approximately same as the length of the two edge sides 110*c* and 110*f* of the riser portion 110. In other alternative embodiments, the lengths of the two edge sides 110*d* and 110*e* of the first riser portion 110, the two edge sides 120*d* and 120*e* of the second riser portion, and the two edge sides 130*d* and 130*e* of the base portion 130 may all be different while the lengths of the remaining edge sides of the two riser portions and the base portion are approximately same.

In some embodiments, after the blank 101 is assembled into the trifold letter card 201, an enclosure is formed with two opposing open ends, which have substantially same triangular shapes (see also FIGS. 2 and 6). One of the open ends is illustrated in FIG. 6, wherein each of two angles 261 and 265 in the trifold letter card 201 may be acute angle, and an angle 267 may be acute angle, right angle, or obtuse angle. The angle 261 is formed by the side edge 130*e* of the base portion 130 and a side edge collectively defined by the side edge 110*e* of the first riser portion 110 and the side edge 140*e* of the engaging portion 140 after the first riser portion 110 and the engaging portion 140 is interlocked; the angle 265 is formed by the side edge 130*e* of the base portion 130 and the side edge 120*e* of the second riser portion 120 in the trifold letter card 201; and the angel 267 is formed by the side edges 110*e* and 120*e* of the two riser portions 110 and 120. Of course, in still other embodiments, one or more side edges of the riser portions 110 and 120, the base portion 130, and the engaging portion 140 may not be straight lines, and may take same or different other shapes, such as curved shapes, decorated V-shapes, and/or other decorated shapes, as may be desirable for particular customers.

Figure 2B:
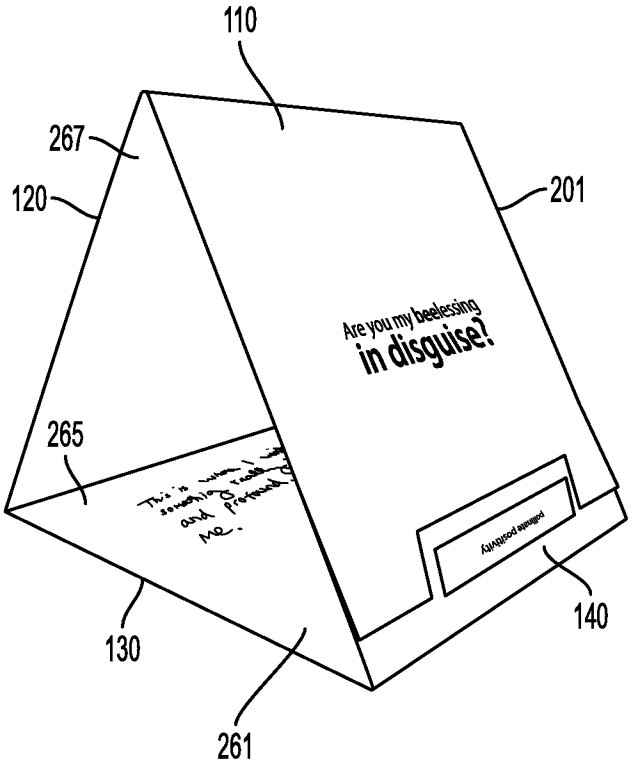
FIG. 2B is another pictorial view of an embodiment of the trifold letter card 201 in a first upright configuration according to the present invention, viewed from another perspective.
Figure 3B:
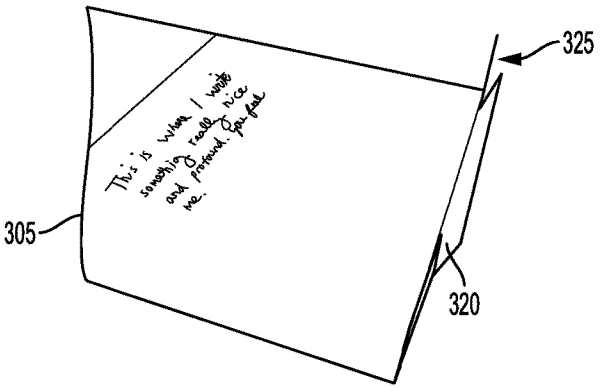

With reference now to FIGS. 3A-C, the engaging portion 140 of the blank 101 may be configured according to various embodiments to receive the first riser portion 110. In at least one embodiment, the engaging portion 140 is formed by at least three segments 141, 142 and 143 (see also FIGS. 5A-D). Each segment of the engaging portion 140 has a second surface (141*b*, 142*b*, 143*b*) and an opposing first surface (141*a*, 142*a*, 143*b*) that are not shown in FIGS. 5A-D. Each segment of the segments 141, 142 and 143 has four side edges (141*c-f*, 142*c-f*, 143*c-f*). The side edge 141*c* of the segment 141 and the side edge 140*e* of the engaging portion 140 are the same side edge, and the side edge 143*f* of the segment 143 and the side edge 140*d* of the engaging portion 140 are the same side edge. The side edges 141*d*, 142*d* and 143*d* of the segments 141, 142 and 143 collectively define the fourth edge of the engaging portion 140. The side edge 141*f* of the segment 141 and the side edge 142*c* of the segment 142 collectively define a first slit 320, and the side edge 142*f* of the segment 142 and the side edge 143*c* of the segment 143 collectively define a second slit 325. In certain embodiments, the engaging portion 140 may be configured to receive and engage the first riser portion 110, as described in further detail below. In certain embodiments, the first riser portion 110 may be inserted into the two slits of the engaging portion 140 so that the first riser portion 110 and the engaging portion 140 are interlocked (see FIGS. 3C and 2B). In certain embodiments, the engaging portion 140 may include a long segment 142 and two short segments 141 and 143. After the engagement, the riser portion 110 and the engaging portion 140 may be positioned so that the first surface 110*a* of the first riser portion 110 is against the second surfaces 141*b* and 143*b* of the two short segments 141 and 143 of the engaging portion 140, and the second surface 110*b* of the first riser portion 110 is against the first surface 142*a* of the long segment 142 of the engaging portion 140. The second surface 142*b* of the long segment 142 may be used to display certain messages, as will be described in further detail below. In alternative embodiments, the engaging portion 140 may include a short segment 142 and two long segments 141 and 143. After the engagement, the riser portion 110 and the engaging portion 140 may be positioned so that the first surface 110*a* of the first riser portion 110 is against the second surface 142*b* of the short segment 142 of the engaging portion 140, and the second surface 110*b* of the first riser portion 110 is against the first surfaces 141*a* and 143*a* of the two long segments 141 and 143 of the engaging portion 140. The second surfaces 141*b* and 143*b* of the long segments 141 and 143 may be used to display certain messages, as will be described in further detail below. With reference again to FIG. 3, the length of each of the two slits 320 and 325 may be between 1/5 and 4/5 of the length of the side edge 140*e* of the engaging portion 140. In at least one such embodiment, the length of each of the two slits 320 and 325 is approximately 2/3 of the length of the side edge 140*e* of the engaging portion 140. In some embodiments, the lengths of the two slits 320 and 325 may be approximately same.

Figure 1B:
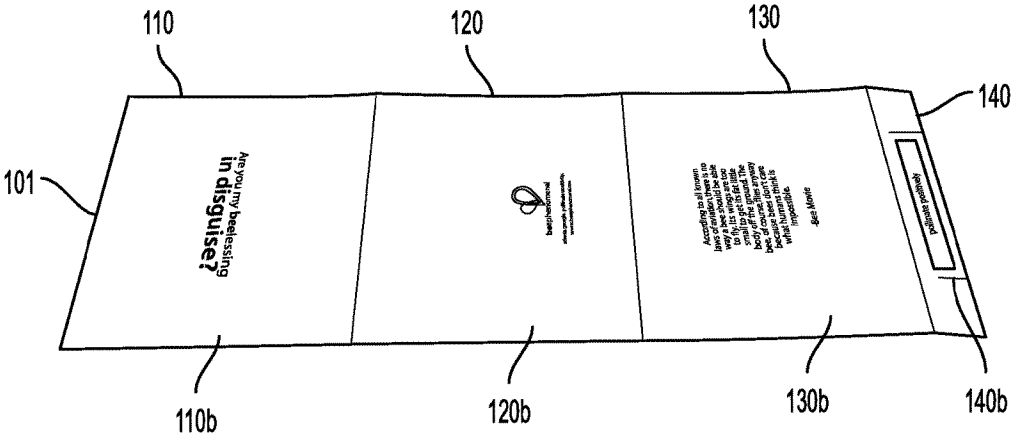
FIG. 1B is a top view of an embodiment of the blank 101 in a first configuration atop a supporting surface 150, with a second surface facing up, according to the present invention.
Figure 2A:
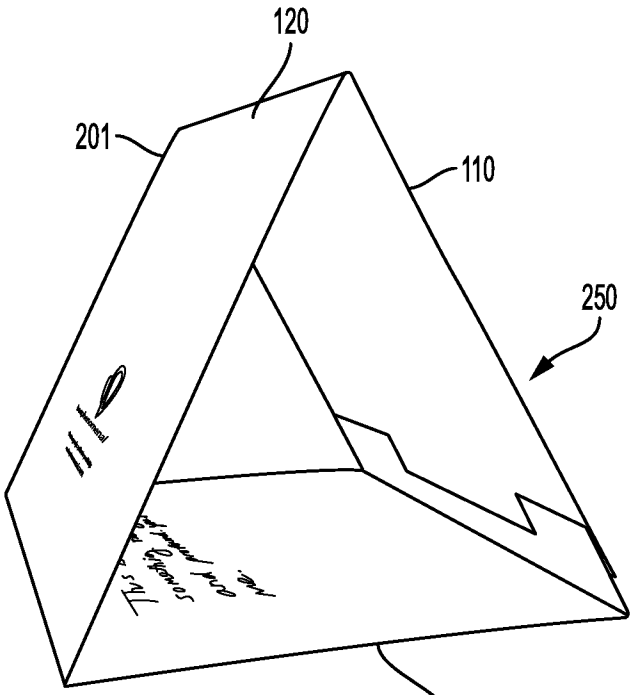
FIG. 2A is a pictorial view of an embodiment of a trifold letter card 201 in a first upright configuration atop a supporting surface 250 according to the present invention.

Returning now with more particular emphasis upon FIGS. 1 and 2, the first and second surfaces of all portions of the blank 101 may be configured to contain message. As will be recognized, the message may take many forms. For instance, the message may be in the form of a text, a graphics, a hologram, and/or the like. The messages on the same surface side of the two riser portions 110 and 120, and the engaging portion 140 may be oriented in a way such that the messages can be easily read after being assembled into the trifold letter card 201 and being displayed in the desired upright configuration. For example, the text messages on the second surface 110*b* of the first riser portion 110 and on the second surface 120*b* of the second riser portion 120 may be oriented oppositely in the blank 101 (FIG. 1B), and positioned in a way so that both text messages are displayed properly in the trifold letter card 201 while in a first upright configuration (see FIGS. 2A-B). The text messages on the second surface 140*b* of the engaging portion 140 and the second surface 110*b* of the first riser portion 110 should be oriented in the same direction in the blank 101 while in an unfolded configuration (FIG. 1B), and positioned in a way so that both text messages are displayed properly in the folded trifold letter card 201 while in a first upright configuration (see FIG. 2B). Of course, in still other embodiments, if a second upright configuration of the trifold letter card 201 is desired (see FIGS. 7A-B), the messages on the same side of the two riser portions 110 and 120, the engaging portion 140, and the base portion 130 may be oriented in a way such that the messages can be easily read in the folded configuration while being displayed in the second upright configuration. For example, the messages on the same surface side of the two riser portions 110 and 120, the base portion 130, and the engaging portion 140 may be oriented in the same direction, either all facing the side edges 110*d*, 120*d*, 130*d*, 140*d*, respectively, or all facing the side edges 110*e*, 120*e*, 130*e*, 140*e*, respectively. Of course, in still other embodiments, the blank 101 may be folded in a way so that the first surfaces 110*a*, 120*a*, 130*a* and 140*a* are facing outside and the messages contained in the first surfaces are displayed in the trifold letter card 201. Accordingly, the orientation of the messages on the first surfaces may be oriented in a way so that they are displayed properly in various folded configurations similar to the corresponding folded configurations described above with the second surfaces facing outside.

With reference now to FIGS. 8A-B, the blank 101 may be configured according to various embodiments to be positioned in a closed configuration. In at least one embodiment, to place the blank 101 in a first closed configuration, the first surface 110*a* of the first riser portion 110 is positioned against the first surface 120*a* of the second riser portion 120, and the first surface 140*a* of the engaging portion 140 is positioned against the first surface 130*a* of the base portion 130 (FIG. 8A). Then, the second surface 110*b* of the first riser portion 110 is positioned against the second surface 140*b* of the engaging portion 140 and part of the first surface 130*a* of the base portion 130 (FIG. 8B). In an alternative embodiment, the blank 101 may be positioned in a second closed configuration, wherein the first surface 110*a* of the first riser portion 110 is positioned against the first surface 120*a* of the second riser portion 120, the second surface 110*b* of the first riser portion 110 is positioned against the first surface 130*a* of the base portion 130, and the first surface 140*a* of the engaging portion 140 is positioned against the second surface 120*b* of the second riser portion 120. In another alternative embodiment, the blank 101 may be positioned in another closed configuration, wherein the second surface 110*b* of the first riser portion 110 is positioned against the second surface 120*b* of the second riser portion 120, the first surface 140*a* of the engaging portion 140 is positioned against the first surface 130*a* of the base portion 130, and the first surface 120*a* of the second riser portion 120 is positioned against the second surface 140*b* of the engaging portion 140 and part of the first surface 130*a* of the base portion 130.

It should be further understood that although the blank 101 has been described as displaying messages contained in the first and second surfaces of the first and second riser portions 110 and 120, the base portion 130, and/or the engaging portion, the blank 101 may also be able to receive and engage other objects for display other messages, as may be desired by particular customers. For instance, at least one of the first riser portion 110, the second riser portion 120, or the base portion 130 may contain at least two slits positioned in a way so that each portion may receive a picture, a photo, and/or the like provided by the customer for display. Alternatively, at least one of the surfaces of the first riser portion 110, the second riser portion 120, or the base portion 130 may have at least two tabs attached to the surface and positioned in a way to receive a picture, a photo, and/or the like provided by the customer for display.

II. Method of Assembly of Trifold Letter Card

FIGS. 9A-D provide an illustration of an assembly of the trifold letter card 201 from the blank 101. Looking at FIG. 9A, the blank 101 displayed in this figure is substantially the same blank 101 previously described with reference to FIGS. 1A-B. That being said, the assembly of the blank for forming the trifold letter card is performed by carrying out a sequence of folding steps upon the blank 101. The sequence of folding steps is explained as set forth below according to an exemplary embodiment of the invention. However, it should be noted that additional folding steps may be performed in certain embodiments, while in other embodiments the sequence of folding steps need not necessarily be performed in the order provided in the explanation given below. For instance, one may perform the folding steps for the first riser portion 110 prior to performing the folding steps for the second riser portion 120, or vice versa. Similarly, one may perform the folding steps for the first riser portion 110 prior to performing the folding steps for the engaging portion 140, or vice versa. Thus, it should be understood that the particular sequence of folding steps provided below are for illustrative purposes only and should not be construed to limit the scope of the claimed invention.

Figure 9A:
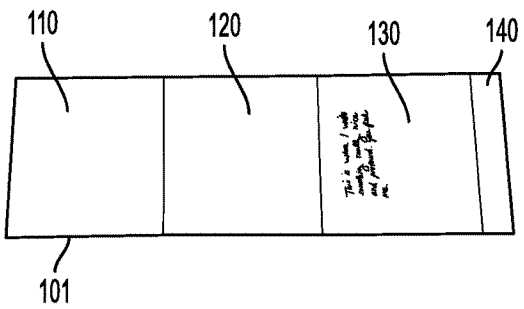
Figure 9B:
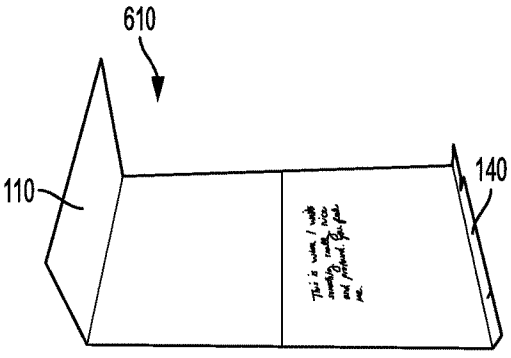
Figure 9C:
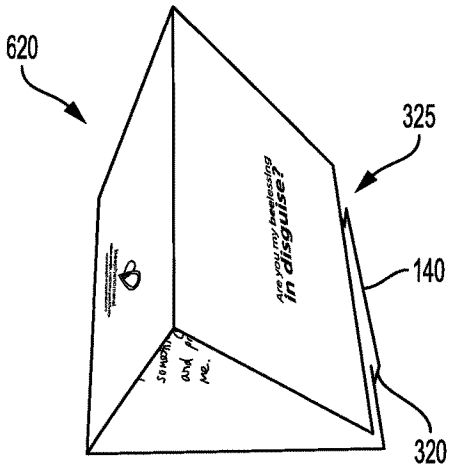
Figure 9D:
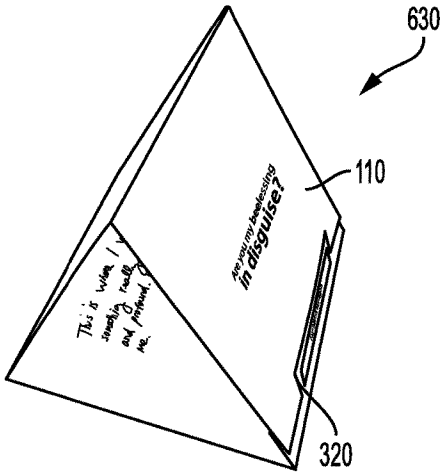

Turning to FIGS. 9B-D, an individual performing the sequence of folding steps on the blank 101 may begin by folding the engaging portion 140 along the third crease line 135 at a first angle, which is an approximately right angle, an acute angle, or an obtuse angle. The individual may continue by folding the first riser portion 110 along the first crease line 115 between the first riser portion 110 and the second riser portion 120 at a second angle, which may be an acute angle, a right angle, or an obtuse angle. The individual may then fold the second riser portion 120 along the second crease line 125 at a third angle, which is an acute angle. At the same time, the individual may adjust the first, second and third angles so that the side edge 110*c* of the first riser portion 110 is substantially aligned with the fourth side edge of the engaging portion 140 collectively defined by the side edges 141*d*, 142*d* and 143*d* (FIG. 9C). Once so aligned, the individual may then insert the first riser portion 110 into the first slit 320 and then into the second slit 325 of the engaging portion 140, so as to secure the first riser portion 110 relative to the engaging portion 140 (FIG. 9D).

It should be understood, of course, that the order of folding the first riser portion 110, the second riser portion 120 and the engaging portion 140 may be changed, or even performed substantially simultaneously, as may be desirable by particular consumers. Still further, it should be understood that the order of inserting the first riser portion 110 into the first slit 320 and the second slit 325 may be reversed, or even performed substantially simultaneously.

Alternatively, the individual may assemble the blank 101 from a closed configuration, such as from the first closed configuration displayed in FIG. 8B. The individual may begin by unfolding the second riser portion 120 along the second crease line 125 to form a fourth angle between the second riser portion 120 and the base portion 130. The individual may continue by unfolding the engaging portion 140 along the third crease line 135 to form a fifth angle between the engaging portion 140 and the base portion 130. The individual may then unfold the first riser portion 110 along the first crease line to form a sixth angle between the first riser portion 110 and the second riser portion 120, and, at the same, the individual may adjust the fourth, fifth and sixth angles so that the side edge 110*c* of the first riser portion 110 is substantially aligned with the fourth side edge of the engaging portion 140 collectively defined by the side edges 141*d*, 142*d* and 143*d* (FIG. 9C). Once so aligned, the individual may then insert the first riser portion 110 into the first slit 320 and then into the second slit 325 of the engaging portion 140, so as to secure the first riser portion 110 relative to the engaging portion 140 (FIG. 9D).

It should be understood, of course, that the order of unfolding the first riser portion 110 and the engaging portion 140 may be reversed, or even performed substantially simultaneously, as may be desirable by particular consumers. Still further, it should be understood that the order of inserting the first riser portion 110 into the first slit 320 and the second slit 325 may be reversed, or even performed substantially simultaneously.

IV. Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. For example, the embodiment described herein may be modified to accept placement of a gift within the cavity formed by the erected trifold configuration of FIG. 9D. As another example, the embodiment described herein or other embodiments may be modified to accept placement of a gift card or the like on at least one of the planar surface portions of the trifold configuration, as commonly known and understood in the art. Although specific terms are employed herein, they are used in a generic and descriptive sense only and not for purposes of limitation.

That which is claimed:

1. A trifold letter card comprising:

(1) a base portion comprising a first side edge, a second side edge, a third side edge, a fourth side edge, a first surface, and a second surface, wherein the first side edge and the third side edge of the base portion are opposite side edges of the base portion and are substantially parallel to one another, and the second side edge and the fourth side edge of the base portion are opposite side edges of the base portion;

(2) a first riser portion comprising a first side edge, a second side edge, a third side edge, a fourth side edge, a first surface, and a second surface, wherein the first side edge and the third side edge of the first riser portion are opposite side edges of the first riser portion and are substantially parallel to one another, and the second side edge and the fourth side edge of the first riser portion are opposite side edges of the first riser portion, wherein the first side edge of the first riser portion is a continuous side edge having no slits formed therein;

(3) a second riser portion comprising a first side edge, a second side edge, a third side edge, a fourth side edge, a first surface, and a second surface, wherein:

(a) the first side edge and the third side edge of the second riser portion are opposite side edges of the second riser portion and are substantially parallel to one another, the second side edge and the fourth side edge of the second riser portion are opposite side edges of the second riser portion;

(b) the third side edge of the first riser portion and the first side edge of the second riser portion collectively define a first crease line; and (c) the third side edge of the second riser portion and the first side edge of the base portion collectively define a second crease line; and (4) an engaging portion comprising a first side edge, a second side edge, a third side edge, a fourth side edge, a first surface, a second surface, at least three segments, and at least two slits, wherein:

(a) the first side edge and the third side edge of the engaging portion are opposite side edges of the engaging portion, and the second side edge and the fourth side edge of the engaging portion are opposite side edges of the engaging portion;

(b) the third side edge of the base portion and the first side edge of the engaging portion collectively define a third crease line;

(c) each of the at least three segments comprising a first side edge, a second side edge, a third side edge, a fourth side edge, a first surface, a second surface, wherein the first side edge and the third side edge of each of the at least three segments are opposite side edges of the corresponding segment, and the second side edge and the fourth side edge of each of the at least three segments are opposite side edges of the corresponding segment;

(d) the first side edge of a first segment of the at least three segments defines the fourth side edge of the engaging portion, the fourth side edge of a third segment of the at least three segments defines the second side edge of the engaging portion, the fourth side edges of the at least three segments in the engaging portion collectively define the first side edge of the engaging portion, the second side edges of the at least three segments in the engaging portion collectively define the fourth side edge of the engaging portion, the first surfaces of the at least three segments collectively define the first surface of the engaging portion, and the second surfaces of the at least three segments collectively define the second surface of the engaging portion;

(e) the third side edge of a first segment of the at least three segments and the first side edge of a second segment of the at least three segments collectively define a first slit of the engaging portion, wherein the first segment is adjacent to the second segment, and the first slit starts from a point on the third side edge of the engaging portion and ends before reaching the first side edge of the engaging portion;

(f) the third side edge of the second segment of the at least three segments and the first side edge of a third segment of the at least three segments collectively define a second slit of the engaging portion, wherein the second segment is adjacent to the third segment, and the second slit starts from another point on the third side edge of the engaging portion and ends before reaching the first side edge of the engaging portion; and (g) the at least two slits of the engaging portion receive and engage the first riser portion along an entirety of the continuous side edge of the first riser portion, and secure the first riser portion to the engaging portion.

2. The trifold letter card of claim 1, further comprising an enclosure portion comprising three side walls and two opposing ends, wherein:

(a) a first side wall is defined by the base portion, a second side wall is defined by the second riser portion, and a third side wall is defined by the first riser portion engaged with the engaging portion;

(b) the two opposing ends are open, wherein a first end of the two opposing ends is formed by the fourth side edges of the base portion, the second riser portion, the first riser portion and the engaging portion, wherein the first riser portion is secured to the engaging portion, a second end of the two opposing ends is formed by the second side edges of the base portion, the second riser portion, the first riser portion and the engaging portion, wherein the first riser portion is secured to the engaging portion; and (c) the first surface of each of all the portions and segments faces inside of the enclosure portion.

3. The trifold letter card of claim 1, wherein the base portion, the first and second riser portions, and the engaging portion are rectangular in shape.

4. The trifold letter card of claim 3, wherein at least one of the base portion, the first riser portion, or the second riser portion has a square shape.

5. The trifold letter card of claim 2, wherein the two opposing ends of the enclosure portion have triangular shapes, wherein:

(1) a first angle, formed by the second side edges of the base portion and the second riser portion, or by the fourth side edges of the base portion and the second riser portion, is an acute angle;

(2) a second angle, formed by the second side edges of the base portion and the first riser portion engaged with the engaging portion, or by the fourth side edges of the base portion and the first riser portion engaged with the engaging portion, is an acute angle, wherein the second side edges or the fourth side edges of the first riser portion and the engaging portion are substantially along a straight line; and (3) a third angle, formed by the second side edges of the first riser portion and the second riser portion, or by the fourth side edges of the first riser portion and the second riser portion, is at least one of an acute angle, a right angle, or an obtuse angle.

6. The trifold letter card of claim 1, wherein:

at least one of the second surfaces of the first riser portion, the second riser portion, the base portion, or one or more segments in the engaging portion contains messages;

the message on the second surface of the first riser portion faces the third side edge of the first riser portion;

the message on the second surface of the second riser portion faces the first side edge of the second riser portion; and the messages on one or more segments of the engaging portion face the third side edge of the engaging portion.

7. The trifold letter card of claim 1, wherein:

at least one of the second surfaces of the first riser portion, the second riser portion, the base portion, or one or more segments in the engaging portion contains messages; and either:

all the messages on the second surface of the portions are oriented to face the second side edges of the corresponding portions and all the messages on the second surface of the segments are oriented to face the second side edge of the engaging portion; or all the messages on the second surface of the portions are oriented to face the fourth side edges of the corresponding portions and all the messages on the second surface of the segments are oriented to face the fourth side edge of the engaging portion.

8. The trifold letter card of claim 1, wherein the at least three segments in the engaging portion comprising at least a long segment and two short segments.

9. The trifold letter card of claim 8, wherein:

(1) the first surface of the long segment is positioned against part of the second surface of the first riser portion; and (2) the second surface of at least one of the two short segments is positioned against part of the first surface of the first riser portion.

10. The trifold letter card of claim 1, wherein the at least three segments in the engaging portion comprising at least two long segments and a short segment.

11. The trifold letter card of claim 10, wherein:

(1) the first surface of at least one of the two long segments is positioned against part of the second surface of the first riser portion; and (2) the second surface of the short segment is positioned against part of the first surface of the first riser portion.

12. The trifold letter card of claim 11, wherein the second surface of at least one of the two long segments contains a message, wherein the message is oriented facing at least one of the second, third, or fourth side edge of the engaging portion.

13. The trifold letter card of claim 1, wherein at least one of the first riser portion, the second riser portion, or the base portion contains at least two slits or tabs configured to receive paper, wherein the paper contains messages.

14. The trifold letter card of claim 1, wherein at least one of the second side edge or the fourth side edge of at least one of the first riser portion, the second riser portion, the base portion, or the engaging portion has at least one of a curved shape or a decorated V-shape.

15. A blank configured to be used to form a trifold letter card, the blank comprising:

(1) a base portion comprising a first side edge, a second side edge, a third side edge, a fourth side edge, a first surface, and a second surface, wherein the first side edge and the third side edge of the base portion are opposite side edges of the base portion and are substantially parallel to one another, and the second side edge and the fourth side edge of the base portion are opposite side edges of the base portion;

(2) a first riser portion comprising a first side edge, a second side edge, a third side edge, a fourth side edge, a first surface, and a second surface, wherein the first side edge and the third side edge of the first riser portion are opposite side edges of the first riser portion and are substantially parallel to one another, and the second side edge and the fourth side edge of the first riser portion are opposite side edges of the first riser portion, wherein the first side edge of the first riser portion is a continuous side edge having no slits formed therein;

(3) a second riser portion comprising a first side edge, a second side edge, a third side edge, a fourth side edge, a first surface, and a second surface, wherein:

(a) the first side edge and the third side edge of the second riser portion are opposite side edges of the second riser portion and are substantially parallel to one another, the second side edge and the fourth side edge of the second riser portion are opposite side edges of the second riser portion;

(b) the third side edge of the first riser portion and the first side edge of the second riser portion collectively define a first crease line; and (c) the third side edge of the second riser portion and the first side edge of the base portion collectively define a second crease line; and (4) an engaging portion comprising two opposing side edges defining there-between two opposing surfaces defining at least three segments and at least two slits, wherein one of the two opposing side edges defines, with the third side edge of the base portion a third crease line, and wherein the at least two slits interrupt the other of the two opposing side edges and are configured to receive and engage the first riser portion along an entirety of the continuous side edge thereof.

16. The blank of claim 15, wherein at least one of the the second riser portion, or the base portion contains at least two slits or tabs to receive paper, wherein the paper contains messages.

17. The blank of claim 15, wherein the base portion, the first and second riser portions, and the engaging portion have rectangular shapes.

18. The blank of claim 15, wherein at least one of the first surface or the second surface of at least one of the first riser portion, the second riser portion, the base portion, or two opposing surfaces of the engaging portion contains messages.

19. The blank of claim 15, wherein at least one of the second side edge or the fourth side edge of at least one of the first riser portion, the second riser portion, or the base portion has curved shape or decorated V-shape.

20. A method for erecting a trifold letter card display, the method comprises the steps of:

(1) providing a trifold letter card display comprising:

a first riser portion with a first side edge and a third side edge in parallel, wherein the first side edge of the first riser portion is a continuous side edge having no slits formed therein, a second riser portion with a first side edge and a third side edge in parallel, a base portion with a first side edge and a third side edge in parallel, and an engaging portion with a first side edge and a third side edge opposing to the first side edge, wherein the third side edge of the first riser portion and the first side edge of the second riser portion collectively define a first crease line, the first side edge of the base portion and the third side edge of the second riser portion collectively define a second crease line, the first side edge of the engaging portion and the third side edge of the base portion collectively define a third crease line, the engaging portion has at least two slits and at least three segments, wherein each of the two slits is formed by two side edges of two adjacent segments, and starts from a point along the third side edge of the engaging portion and ends before reaching the first side edge of the engaging portion;

(2) folding the engaging portion at an acute angle, an approximate right angle, or an obtuse angle relative to the base portion;

(3) folding the first riser portion at an acute angle, an approximate right angle, or an obtuse angle relative to the second riser portion;

(4) folding the second riser portion at an acute angle relative to the base portion;

(5) adjusting the angles formed by the second riser portion and the base portion, by the engaging portion and the base portion, and by the first riser portion and the second riser portion so that the first side edge of the first riser portion is substantially aligned with the fourth side edge of the engaging portion; and (6) inserting the first riser portion into the at least two slits of the engaging portion so as to secure the first riser portion relative to the engaging portion along an entirety of the continuous side edge of the first riser portion.

* * * * *